US008136319B2

(12) United States Patent
Kelly

(10) Patent No.: US 8,136,319 B2
(45) Date of Patent: Mar. 20, 2012

(54) HAIL DAMAGE-RESISTANCE ROOF ASSEMBLY AND METHOD FOR MAKING SAME

(76) Inventor: Thomas L. Kelly, Waterbury, CT (US)

( * ) Notice: Subject to any disclaimer, the term of this patent is extended or adjusted under 35 U.S.C. 154(b) by 606 days.

(21) Appl. No.: 10/737,088

(22) Filed: Dec. 16, 2003

(65) Prior Publication Data

US 2005/0126099 A1 Jun. 16, 2005

(51) Int. Cl.
*E04B 7/22* (2006.01)

(52) U.S. Cl. ..... 52/409; 52/411; 52/408; 52/94

(58) Field of Classification Search ..... 52/409, 52/411, 408, 94, 506.01, 96
See application file for complete search history.

(56) References Cited

U.S. PATENT DOCUMENTS

| | | | | | |
|---|---|---|---|---|---|
| 2,057,654 | A | * | 10/1936 | Voigt | 52/97 |
| 2,744,589 | A | * | 5/1956 | Jenkins et al. | 52/404.2 |
| 2,799,232 | A | * | 7/1957 | Jaeger | 52/409 |
| 3,113,402 | A | * | 12/1963 | Butler | 52/745.05 |
| 3,307,306 | A | * | 3/1967 | Oliver | 52/409 |
| 4,226,071 | A | * | 10/1980 | Bennett | 52/745.01 |
| 4,335,557 | A | * | 6/1982 | Morton | 52/745.05 |
| 4,493,175 | A | * | 1/1985 | Coppola, Jr. | 52/410 |
| 5,406,765 | A | * | 4/1995 | Brown | 52/409 |
| 5,560,150 | A | * | 10/1996 | Pearson | 52/79.14 |
| 5,584,153 | A | * | 12/1996 | Nunley et al. | 52/410 |
| 5,784,846 | A | * | 7/1998 | Godschalx | 52/409 |
| 6,006,482 | A | * | 12/1999 | Kelly | 52/409 |
| 6,055,786 | A | * | 5/2000 | Hubbard et al. | 52/409 |
| 6,108,993 | A | * | 8/2000 | Hageman | 52/408 |
| 6,250,036 | B1 | * | 6/2001 | Nurley et al. | 52/537 |
| 6,931,809 | B1 | * | 8/2005 | Brown et al. | 52/409 |

FOREIGN PATENT DOCUMENTS

| | | | | |
|---|---|---|---|---|
| EP | 258174 | * | 6/1987 | 52/408 |
| GB | 2088452 | * | 6/1982 | 52/408 |
| JP | 6-158832 | * | 6/1994 | 52/409 |

* cited by examiner

*Primary Examiner* — Phi Dieu Tran A
(74) *Attorney, Agent, or Firm* — Cantor Colburn LLP

(57) ABSTRACT

Disclosed herein is a hail resistant roof system having a roof deck. An insulation layer is supported by the roof deck. An energy absorbing layer supported by the insulation layer and a waterproof membrane loose laid over the energy absorbing layer. A wind blown debris resistant roof system is disclosed that includes a roof deck with a secondary waterproof membrane disposed over the deck. A layer of stiff material is attached to the roof deck and a primary waterproofing membrane is supported by the stiff material. Further, a roof insulation and waterproofing construction upwardly adjacent the waterproofing membrane. Also disclosed herein is a hail resistant roof system. The system includes a roof deck with a secondary waterproofing membrane. An insulation layer is supported by the roof deck. An energy absorbing layer is supported by the insulation layer and a primary waterproof membrane is loose laid over the energy absorbing layer.

22 Claims, 6 Drawing Sheets

HAIL DAMAGE-RESISTANCE ROOF ASSEMBLY AND METHOD FOR MAKING SAME

BACKGROUND

Large roof structures which are typically more common in the commercial industry, but not exclusive thereto, provide a very large surface area which necessarily increases the possibility of impact and potential damage by hail or wind blown debris in the event of more unfavorable weather conditions. Roofing companies and roof owners are both, understandably, quite concerned about the potential damage of hail and wind blown debris since if a roof system is catastrophically failed by either one of or both of those implements, substantial damage is incurred. The damage occurs in the roof structure itself, replacement of which is not inexpensive and beyond that can be incurred for structures, equipment or inventory stored within the building. Clearly, this kind of damage is associated with potentially massive cost. Art work or sensitive equipment are but two possible items contained within a building which would be utterly destroyed by any significant amount of water being introduced thereto. For these reasons the industry has long attempted to build roof structures capable of handling such aggressors as hail and wind blown debris. One system which does have some ability to ward off hail and wind blown debris employs waterproof structures and a gravel top layer. Historically such structures were being built in many venues, however, more recently the industry has moved toward membrane type roof systems without gravel topping structures for several reasons which are not germane hereto. This has made the risk from hail and wind blown debris more of a concern. To date, however, there are no effective solutions for the problem.

SUMMARY

Disclosed herein is a hail resistant roof system having a roof deck. An insulation layer is supported by the roof deck. An energy absorbing layer supported by the insulation layer and a waterproof membrane loose laid over the energy absorbing layer.

A wind blown debris resistant roof system is disclosed that includes a roof deck with a secondary waterproof membrane disposed over the deck. If the roof deck is weak and cannot resist wind blown debris itself a layer of stiff material is also attached to the roof deck before the secondary waterproofing membrane is installed. Further, a roof insulation energy adsorbing layer and primary waterproofing construction is installed over the secondary waterproofing membrane.

Also disclosed herein is a hail resistant roof system. The system includes a roof deck. An insulation layer is supported by the roof deck. An energy absorbing layer is supported by the insulation layer and a primary waterproof membrane is loose laid over the energy absorbing layer.

BRIEF DESCRIPTION OF THE DRAWING

Referring to the drawings wherein like elements are numbered alike in the several Figures.

DETAILED DESCRIPTION

It will be understood by one of ordinary skill in the art that a hail resistant roof assembly and a wind blown debris resistant roof assembly are related in that the top layer of these assemblies is configured to absorb an impact from a solid object. The roof embodiments that are considered to be wind blown debris resistant roof assemblies further include an additional waterproofing membrane in a protected location in a roof construction. The distinction is that while the hail resistant roof assemblies are intended to absorb impact there are some impacts sustainable from wind blown debris that will be far in excess of the capability of the hail resistant roof assembly to prevent the waterproofing membrane from rupturing. In order to avoid the deleterious effects of water coming through the roof membrane into a building, an additional membrane is provided to prevent water infiltration to the building. Where significantly large wind blown debris is not anticipated, a hail resistant roof assembly will be sufficient.

Figure 1:
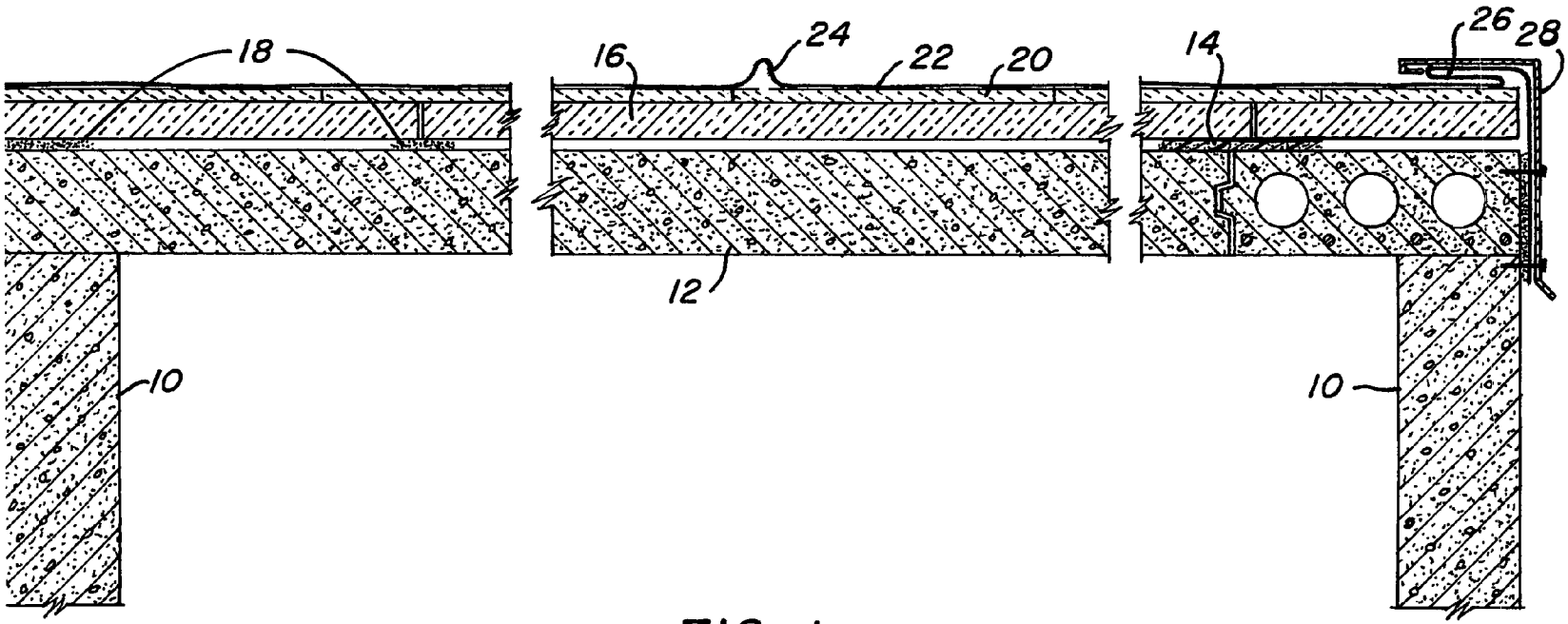
FIG. 1 is a schematic representation of a first embodiment of a hail resistant roof assembly.
Figure 2:
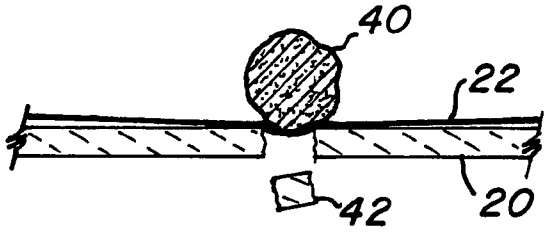
FIG. 2 is a schematic cross-sectional view of an energy absorber/dissipater at a first stage of breaking.
Figure 4:
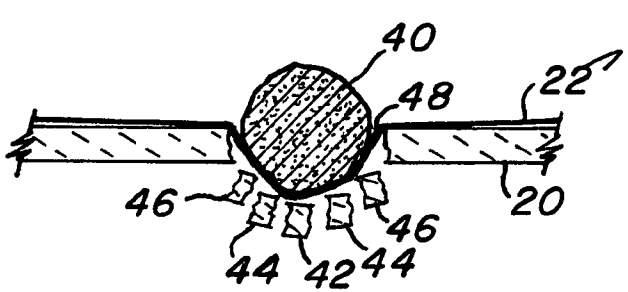
FIG. 4 is a schematic cross-sectional view of an energy absorber/dissipater at a third stage of breaking.
Figure 3:
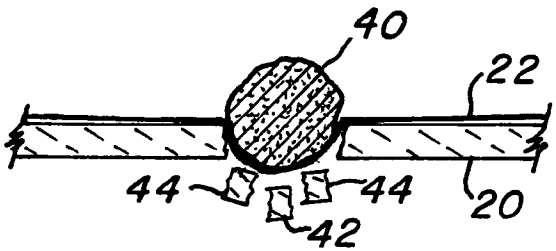
FIG. 3 is a schematic cross-sectional view of an energy absorber/dissipater at a second stage of breaking.

Referring to FIG. 1, the general concept of the hail resistant roof assembly is ascertainable from review of the first embodiment thereof. In order to more clearly illustrate the roof assembly, walls 10 and roof deck 12 provide an indication of the basic structure. Above the roof deck 12 is sufficient material to make the roof deck monolithic. This may be either strips of membrane material 14 as shown, a polyurethane foam or other material sufficiently impermeable to create an air sealed deck or substrate surface. It is noted that inherently air sealed decks such as concrete (poured-in-place) are also contemplated. Once the deck or substrate above the deck has been sufficiently air sealed, an insulation layer 16 is loose laid thereupon. The insulation can also be adhered entirely or spot adhered as illustrated at 18 to the air sealed roof deck 12. Adherence may be effected by glue or other substance or configuration that does not render the air seal configuration ineffective. Mechanical fasteners are only employed if they too are sealed so the substrate air seal is not lost. The insulation is a rigid roof insulation having a minimum one pound density 1 ½ inch thickness in expanded polystyrene or polyisocyanurate. Above and supported by the insulation 16 is an impact absorber dissipater 20. In one embodiment absorber/dissipater 20 is gypsum board. The board in one embodiment is about ½" thick. In the case of gypsum board, energy absorption/dissipation occurs in the form of a successive breaking of the board which is illustrated in drawings FIGS. 2, 3 and 4 in sequence. Breakage may be generally concentric or spiral for individual locations. During the rapid stepwise breakage following an impact from a hail stone or other similar object, kinetic energy is absorbed. More specifically, some of the total kinetic energy of the object is absorbed with each breakage until sufficient kinetic energy has been absorbed that the hailstone can no longer break the board. The stone has thus been effectively stopped. Gypsum board is particularly effective because small sections break at the break site so that the roof structure "bounces back" to some extent. Although three breakages are illustrated in FIGS. 2-4 this is but one example. More or fewer breakages are possible and correspond to the amount of energy in the solid object. As illustrated, FIG. 2 shows one breakage 42; FIG. 3 shows two breakages 42 and 44; and FIG. 4 shows three breakages 42, 44 and 46. As illustrated sequentially in FIGS. 2-4, the object 40 is protruding farther into absorber/dissipater 20.

Referring back to FIG. 1, a waterproofing membrane 22 is loose laid on absorber/dissipater 20. Further, in one embodiment a wrinkle 24 is intentionally created in membrane 22 to keep additional membrane material "in reserve". The excess membrane in wrinkle 24 provides material that can be "pulled" by object 40 into a depression created thereby preventing rupture of membrane 22. In combination with wrinkle 24 or in another embodiment not having wrinkle 24, a fold 26 is created for the same purpose as wrinkle 24. In both cases, the provision prevents membrane 22 being held taught. If membrane 22 is taught, it is more likely to rupture because incident to the impact, a depression will be formed in the roof assembly. In the event membrane 22 cannot move into the depression, it will be caused to stretch into the depression, and rapidly, making rupture more likely. The foregoing is illustrated in FIGS. 2-4 wherein the membrane material may be pulled into a depression 48 formed by object 40.

Referring to fold 26, it is noted that the fold is located beneath inverted "L" metal 28 and that metal 28 is configured, including attachment to the roof deck 12 if any, not to inhibit the movement of membrane 22 from fold 26. In the event metal 28 is adhered to membrane 22 it will be with an adhesive which can be defeated by an anticipated magnitude of pull on membrane 22 as is generated by a hypothetical object 40. In one embodiment, the adhesive is butyl rubber.

Figure 5:
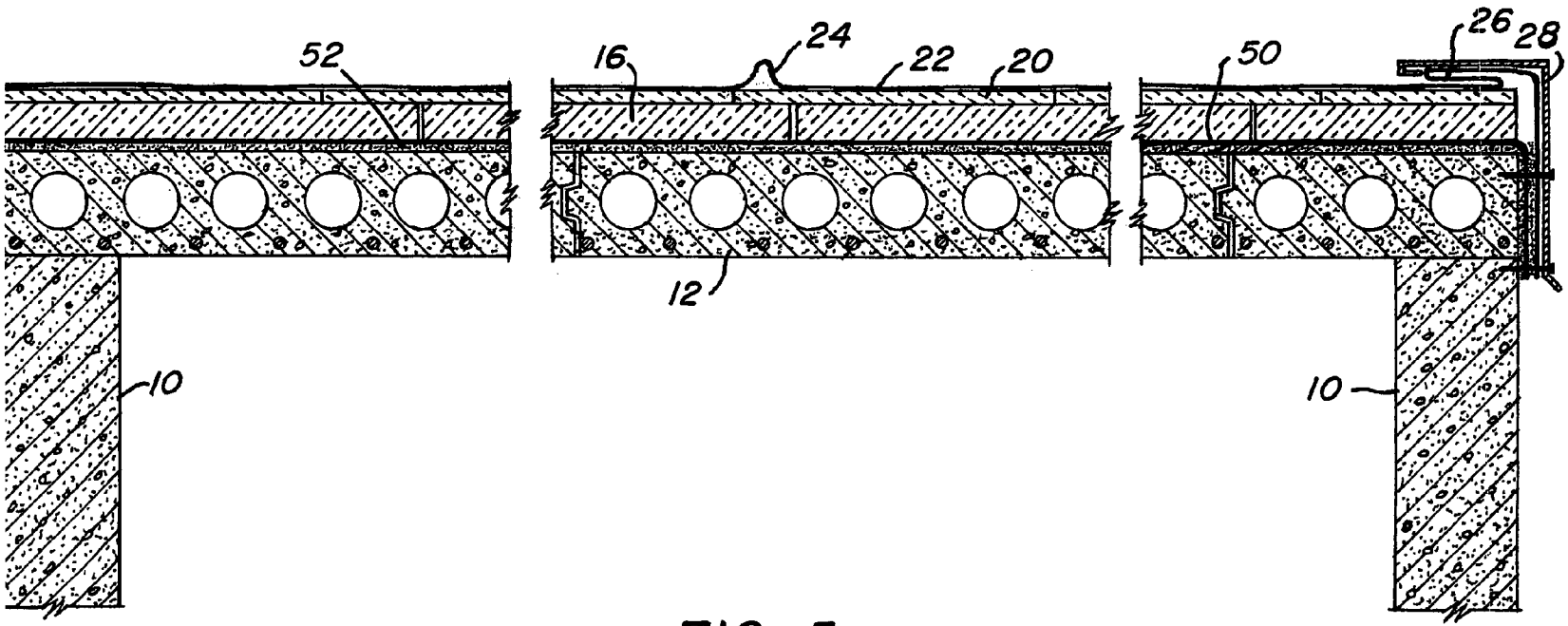
FIG. 5 is similar to the FIG. 1 embodiment however it has been modified to also be a wind blown debris resistant roof assembly.

Referring now to FIG. 5, an alternate embodiment directed to wind blown debris resistance as well as hail resistance is illustrated. Several of the elements of FIG. 5 are identical to those discussed with respect to FIG. 1. These elements are identified with identical numerals to FIG. 1. The distinction, as will be readily appreciated from perusal of FIGS. 1 and 5 simultaneously.

Atop roof deck 12 is a membrane 50 which in one embodiment is adhered to deck 12. As illustrated the adhesive 52 extends to all locations under membrane 50. It is also possible to spot adhere membrane 50 to deck 12 but is still desirable to maintain the placement of adhesive on deck joints as in FIG. 1 to prevent air from migrating to locations under membrane 50 from within the building structure weather sealed by the roof depicted. In this embodiment, membrane 50 provides additional water proofing for the roof in that in the event that wind blown debris impacts the membrane 22 with energy sufficient to rupture membrane 22, membrane 50 will prevent interior building damage until the roof system can be repaired. The system of FIG. 5 works identically to that of FIG. 1 for smaller impacts but provides the additional protective margin of membrane 50 for eventualities rupturing membrane 22.

Figure 6:
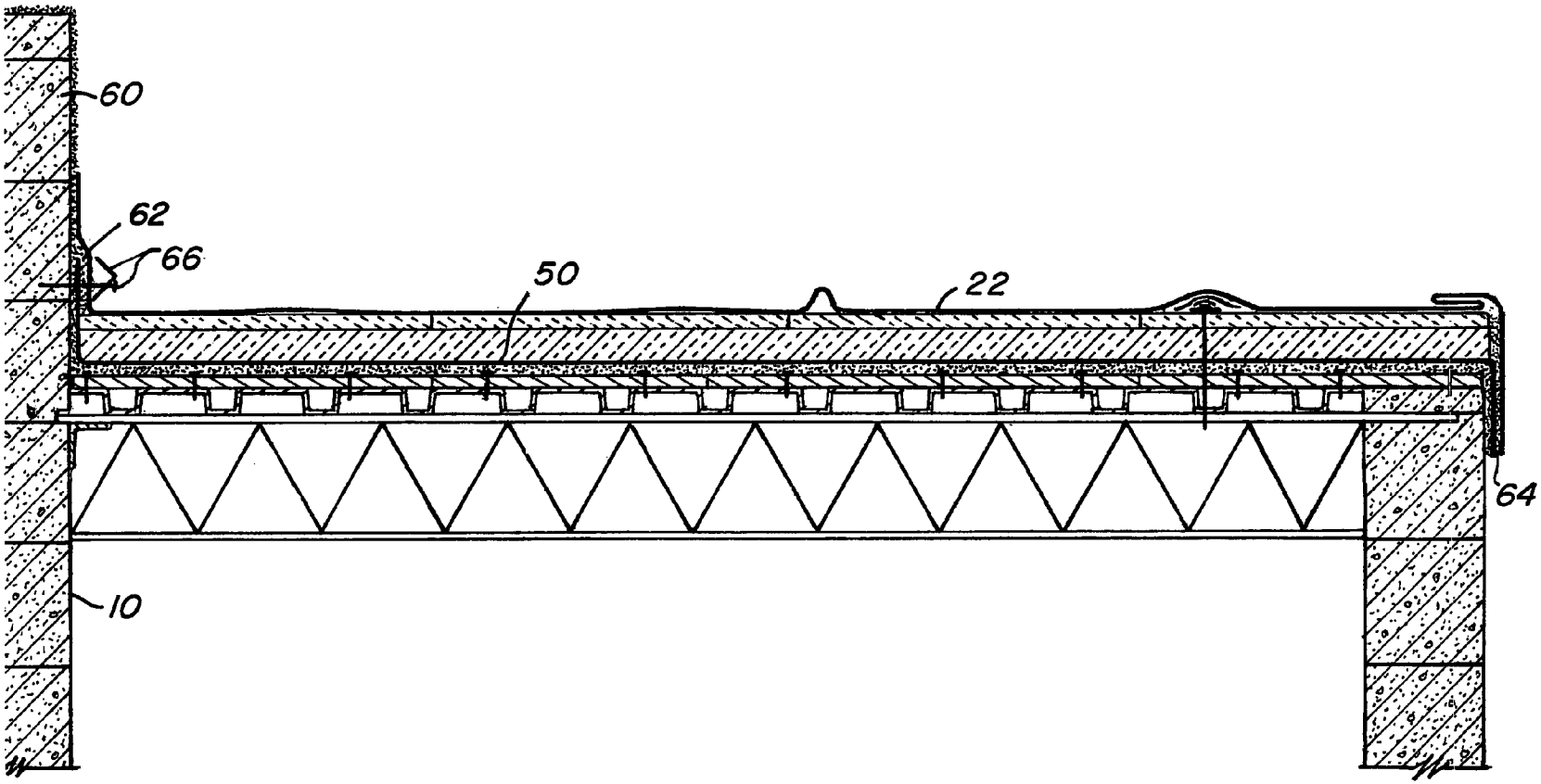
FIG. 6 is an alternate embodiment of the wind blown debris resistant roof assembly.

Referring to FIG. 6, an alternate windblown debris resistant roof assembly with a deck that could be impacted or penetrated by flying debris and an additional strengthening board of plywood, OSB wafer, gypsum or similar is added to the deck is illustrated wherein the assembly is configured for a building 10 having a parapet 60. Membrane 50 is brought up parapet 60 to a level above the "field" of membrane 22 such that membrane 22 is securable and air sealable to membrane 50 by adhesive 62. Adhesive 62, and adhesive 64 at an opposite roof edge maintain an air sealed roof assembly between membrane 22 and membrane 50. It may additionally be desirable to mechanically attach membranes 50 and 22 to parapet 60 with fastener 66 with appropriate sealing compound such as butyl rubber. In other respects the embodiment is similar to the foregoing.

Figure 7:
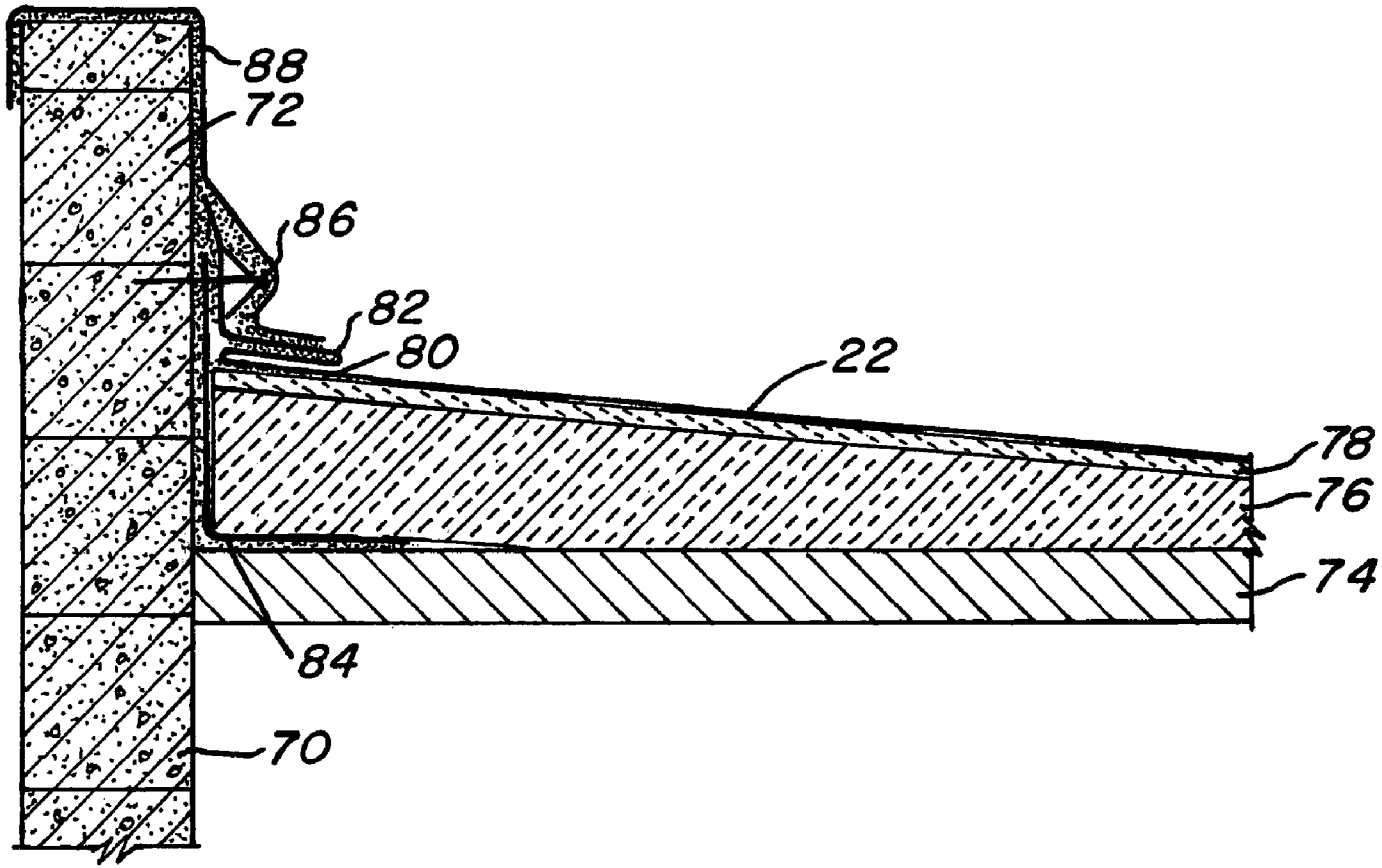
FIG. 7 is an alternate embodiment of a hail resistant roof assembly.

Referring to FIG. 7, a pitched roof assembly is illustrated in a configuration allowing for hail resistance. Building 70 includes parapet 72 and a roof deck 74. Above roof deck 74 is an angled layer of insulation 76. Above the insulation 76 is an absorption/dissipation layer 78, which in one embodiment is gypsum board. A membrane 22 is lose laid thereover except proximate the parapet 72 where adhesive 80 is placed to maintain membrane 22 in a desirable position during normal operation and configured to fail under shear load in the event of a hailstone impact to allow fold 82 to be "pulled" out across the roof assembly. This is similar to foregoing embodiments and does not require further detailed discussion here. It is noted that in this embodiment adhesive 80 is also placed between layers of the membrane 22. After fold 82 membrane continues onto parapet 72 and is adhesively affixed to membrane section 84, which itself is adhesively affixed to parapet 72 and to deck 74 in an air sealed manner. In one embodiment, membrane 22 and section 84 are also mechanically affixed to parapet 72 with fastener 86. In this illustration a further water proofing member 88, which may be membrane or metallic, or other waterproofing, environment-resisting material is adhesively affixed on the top of parapet 72 and extends down beyond fastener 86 to shed water over the fastener helping to avoid leaks.

Figure 8:
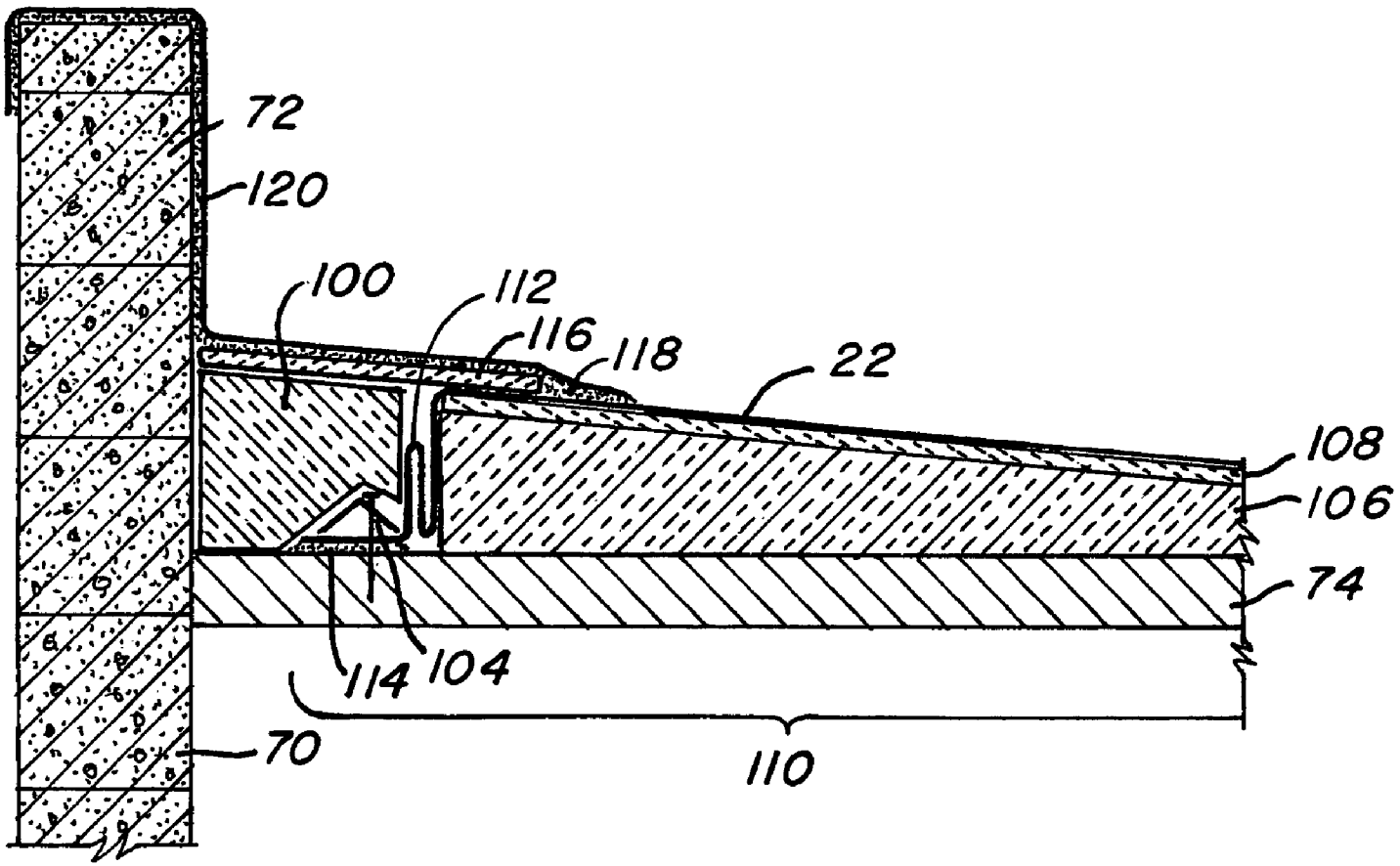
FIG. 8 is an alternate embodiment of a hail resistant roof assembly.

Referring now to FIG. 8, another alternate embodiment is illustrated. In this embodiment, the structural components of the building are identical and are thus labeled identically. The roof assembly is distinct however. In this embodiment, angled insulation is used as in a foregoing embodiment, however the insulation is specifically configured to receive a fold of membrane 22. Insulation perimeter section 100 is undercut at 102 to leave space for a mechanical fastener 104 fastening a perimetral edge of roof membrane 22 and is installed after the installation of the field section of the roof assembly including insulation 106, absorption/dissipater board 108 and membrane 22.

As it appears to one of ordinary skill in the art from a review of FIG. 8, membrane 22 is loose laid over board 108 and insulation 106 similar to foregoing embodiments. At a perimeter edge of field section 110. Membrane 22 is folded on itself as 112 before being fastened to deck 74 with fastener 104 and adhesive 114. Subsequent to such securement, insulation 100 is installed over termination 104 and weighted in place with board 116 insulation 100 and a portion as illustrated of membrane 22 (and sub assembly). This board 116 may also be gypsum board. Finally, an additional waterproofing material, being membrane or metal or equivalent is adhered to membrane 22 at 118 and to board 116 parapet 72 with adhesive 120. It will be appreciated from the foregoing discussion that 118 is an adhesive designed to fail under shear such that fold material at 112 can be pulled out onto the roof field in the event of age related shrinkage and/or a hail stone impact to reduce tensile force on the membrane thereby averting a membrane rupture.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A hail resistant roof system comprising:

a roof deck;

an insulation layer supported by said roof deck, wherein said insulation layer is more compressible and resilient than said roof deck;

a frangible energy absorbing layer supported by said insulation layer, wherein said energy absorbing layer is of a different material than said insulation layer; and a waterproof membrane loose laid over said frangible energy absorbing layer, such that said waterproof membrane is completely unattached to any portion of the roof system at any area of said waterproof membrane running substantially parallel to a relatively upper surface of said frangible energy absorbing layer, said waterproof membrane only being attached to the roof system at an area of the waterproof membrane running substantially perpendicular to said relatively upper surface of said frangible energy absorbing layer;

at least one intentional wrinkle in said waterproof membrane, said wrinkle being excess membrane material that is pulled upward from said relatively upper surface of said frangible energy absorbing layer relative to portions of said waterproof membrane on both sides of said wrinkle, said wrinkle being disposed over an open area of said relatively upper surface of said frangible energy absorbing layer that is absent any attachment structure, adhesive, or other structure protruding upwardly from said relatively upper surface of said frangible energy absorbing layer relative to a substantial remainder of said relatively upper surface of said frangible energy absorbing layer at any area under said wrinkle, said open area between said waterproof membrane and said relatively upper surface of said frangible energy absorbing layer at said wrinkle allowing said waterproof membrane to be pulled down towards said relatively upper surface of said frangible energy absorbing layer in response to hail impact upon the waterproof membrane without interference from any attaching to said relatively upper surface of said frangible energy absorbing layer or structure between said waterproof membrane and said relatively upper surface of said frangible energy absorbing layer at said wrinkle.

2. A hail resistant roof system as claimed in claim 1 wherein said energy absorbing layer is gypsum board.

3. A hail resistant roof system as claimed in claim 2 wherein said gypsum board is ½ inch thick.

4. A hail resistant roof system as claimed in claim 1 wherein said membrane is fiberglass reinforced.

5. A hail resistant roof system as claimed in claim 1 wherein said membrane is about 80 mil fiberglass reinforced or thicker.

6. A hail resistant roof system as claimed in claim 1 wherein joints in said insulation layer are offset from joints in said energy absorbing layer.

7. A hail resistant roof system as claimed in claim 1 wherein said insulation is of a resilient material.

8. A hail resistant roof system as claimed in claim 7 wherein said resilient material is about 1.5 inches thick or more.

9. A hail resistant roof system as claimed in claim 1 wherein said deck or substrate is air sealed.

10. A hail resistant roof system as claimed in claim 1 wherein said membrane is air sealed to a wall structure.

11. A hail resistant roof system as claimed in claim 1 wherein said at least one wrinkle is located within a field of said membrane.

12. A hail resistant roof system as claimed in claim 1 wherein said waterproof membrane further includes a fold that folds back upon itself in at least one layer, said fold being located at a perimeter edge of said roof deck.

13. A hail resistant roof system comprising:

a roof deck or air sealed substrate;

a primary waterproofing membrane disposed over at least a substantial portion of said roof deck or air seal substrate;

an insulation layer loose laid over primary waterproofing membrane;

an energy absorbing layer supported by said insulation layer, wherein said energy absorbing layer is of a different material than said insulation layer; and a secondary waterproof membrane loose laid over said energy absorbing layer, such that said waterproof membrane is completely unattached to any portion of the roof system at any area of said secondary waterproof membrane running substantially parallel to a relatively upper surface of said frangible energy absorbing layer, said waterproof membrane only being attached to the roof system at an area of the waterproof membrane running substantially perpendicular to said relatively upper surface of said frangible energy absorbing layer;

at least one intentional wrinkle in said secondary waterproof membrane, said wrinkle being excess membrane material that is pulled upward from said relatively upper surface of said frangible energy absorbing layer relative to portions of said waterproof membrane on both sides of said wrinkle -disposed over an open area of said relatively upper surface of said frangible energy absorbing layer that is absent any attachment structure, adhesive, or other structure protruding upwardly from said relatively upper surface of said frangible energy absorbing layer relative to a substantial remainder of said relatively upper surface of said frangible energy absorbing layer at any area under said wrinkle, said open area between said secondary waterproof membrane and said relatively upper surface of said frangible energy absorbing layer at said wrinkle allowing said secondary waterproof membrane to be pulled down towards said relatively upper surface of said frangible energy absorbing layer in response to hail impact upon the waterproof membrane without interference from any attaching to said relatively upper surface of said frangible energy absorbing layer or structure between said secondary waterproof membrane and said relatively upper surface of said frangible energy absorbing layer at said wrinkle.

14. A hail resistant roof system as claimed in claim 13 wherein said energy absorbing layer is gypsum board.

15. A hail resistant roof system as claimed in claim 13 wherein joints in said insulation layer are offset from joints in said energy absorbing layer.

16. A hail resistant roof system as claimed in claim 13 wherein said insulation is of a resilient material.

17. A hail resistant roof system as claimed in claim 1 wherein said deck is air sealed.

18. A hail resistant roof system as claimed in claim 1 wherein said membrane is air sealed to a wall structure.

19. A hail resistant roof system as claimed in claim 13 wherein said at least one wrinkle is located within a field of said membrane.

20. A hail resistant roof system as claimed in claim 13 wherein said secondary waterproof membrane further includes a fold that folds back upon itself in at least one layer, said fold being located at a perimeter edge of said roof deck.

21. A hail resistant roof system as claimed in claim 1 further comprising a preexisting roof assembly that is air sealed underlying at least the energy absorbing layer.

22. A hail resistant roof system comprising:

a roof deck;

a resilient roof insulation layer disposed upon said roof deck, wherein said insulation layer is at least one of expanded polystyrene (EPS) and polyisocyanurate foam (ISO);

at least 0.5 inches of gypsum board disposed upon said insulation layer, wherein the insulation layer is configured to compress to allow energy absorption when the gypsum is struck by an object; and a loose laid, non-reinforced waterproofing membrane with fabricated wrinkles disposed upon said gypsum board, such that said waterproof membrane is completely unattached to any portion of the roof system at any area of said waterproof membrane running substantially parallel to a relatively upper surface of said gypsum board, said waterproof membrane only being attached to the roof system at an area of the waterproof membrane running substantially perpendicular to said relatively upper surface of said gypsum board, wherein said wrinkles are in said waterproof membrane, said wrinkles being excess membrane material that pulled upward from said relatively upper surface of said gypsum board relative to portions of said waterproof membrane on both sides of said wrinkle -disposed over an open area of said relatively upper surface of said gypsum board that is absent any attachment structure, adhesive, or other structure protruding upwardly from said relatively upper surface of said gypsum board relative to a substantial remainder of said relatively upper surface of said gypsum board at any area under said wrinkle, said open area between said waterproof membrane and said relatively upper surface of said gypsum board at said wrinkle allowing said waterproof membrane to be pulled down towards said relatively upper surface of said gypsum board in response to hail impact upon the waterproof membrane without interference from any attaching to said relatively upper surface of said gypsum board or structure between said waterproof membrane and said relatively upper surface of said gypsum board at said wrinkle.

* * * * *